US005320293A

United States Patent [19]

Laly et al.

[11] Patent Number: 5,320,293

[45] Date of Patent: Jun. 14, 1994

[54] ROTARY GRINDER EXPLOYING BLADES

[75] Inventors: Jean-Pierre Laly, Crepy-en-Valots; Jean-Marie Prodhomme, Levergies, both of France

[73] Assignee: CIMP S.A., France

[21] Appl. No.: 101,655

[22] Filed: Aug. 3, 1993

Related U.S. Application Data

[63] Continuation of Ser. No. 835,193, Feb. 13, 1992, abandoned.

[51] Int. Cl.[5] ..... B02C 18/06

[52] U.S. Cl. ..... 241/242; 241/293; 241/189.1

[58] Field of Search ..... 241/73, 189.1, 191, 241/242, 293, 294

[56] References Cited

U.S. PATENT DOCUMENTS

| | | | |
|---|---|---|---|
| 136,321 | 2/1873 | Harvey | 241/293 X |
| 1,150,219 | 8/1915 | Monahan | 241/242 |
| 2,299,866 | 10/1942 | Willard | 241/294 X |
| 2,865,572 | 12/1958 | Lannert | 241/294 |
| 3,823,633 | 7/1974 | Ross | 241/294 X |
| 4,011,998 | 3/1977 | Holdeman et al. | 241/294 X |
| 4,061,284 | 12/1977 | Raisbeck et al. | 241/294 |
| 4,176,800 | 12/1979 | Brewer | 241/294 X |
| 4,205,799 | 6/1980 | Brewer | 241/294 X |
| 4,257,566 | 3/1981 | Lawrence | 241/294 X |

FOREIGN PATENT DOCUMENTS 2511893 4/1983 France .

*Primary Examiner*—Richard K. Seidel
*Assistant Examiner*—Clark F. Dexter
*Attorney, Agent, or Firm*—Ladas & Parry

[57] ABSTRACT

A rotary grinder employing blades is disclosed, which comprises a substantially cylindrical rotor, on the periphery of which is mounted, along certain regularly spaced apart generatrix lines, a plurality of identical blades of short length with respect to the length of the rotor, wherein the blades are disposed at a rate of one blade per generatrix line and so that two blades located on adjacent a generatrix lines present therebetween, longitudinally, a distance approximately equal to or greater than a length of blade.

5 Claims, 4 Drawing Sheets

ROTARY GRINDER EXPLOYING BLADES

This is a continuation of copending application Ser. No. 07/835,193 filed on Feb. 13, 1992, now abandoned.

FIELD OF THE INVENTION

The present invention relates to a rotary grinder, also called a grinding or shredding machine or a granulator, which is equipped with blades or knife blades mounted on a rotor, namely a generally cylindrical rotating part. The present invention concerns more particularly a rotary grinder equipped with a plurality of identical blades of small length with respect to the length of the rotor.

BACKGROUND OF THE INVENTION

In a rotary grinder of this type, the material is divided and ground by a combination of shock and shearing effects between the rotating blades of the rotor and one or more blades fixed on a frame which surrounds the rotor.

A rotary grinder of this type is described in document FR 2 511 893. In this known grinder, the blades are disposed on the rotor so that, when one blade is working, the preceding one serves as stop for the material pushed by the working blade, so as to provoke a screw effect which imparts to the material a displacement having a component parallel to a generatrix line of the rotor. More particularly, in the document mentioned above, the blades mounted on the rotor are disposed in two antagonistic series of blades in staircase form so that these blades enter into action successively, each series beginning at one end of the rotor and terminating in the central region thereof, so that the resulting Archimedean screw effect acts on the material in two opposite directions going from the two ends of the rotor up to its central region. The aim of this document is to detach all material from the end zones in which are located the bearings which support the rotation shaft of the rotor.

However, Applicants have observed that, although there was effectively a clearing of the end zones corresponding to the location of the bearings, there was, on the other hand, an accumulation of the materials to be ground towards the central part of the rotor, such an accumulation being detrimental to the correct homogeneous functioning of the grinder.

It is an object of the present invention to propose a rotary grinder employing blades, which does not present the drawbacks set forth hereinabove, namely of which the arrangement of the blades makes it possible not only to avoid an accumulation of materials in the end zones in which are located the bearings supporting the rotation shaft of the grinder, but also to obtain a perfect operational homogeneity over the whole length of the rotor.

This object is perfectly attained by the rotary grinder of the invention, which is a rotary grinder employing blades, comprising, in known manner, a substantially cylindrical rotor on the periphery of which is mounted, along certain regularly spaced apart generatrix lines, a plurality of identical blades of small length with respect to the length of the rotor.

According to one characteristic feature, the blades are disposed at a rate of one blade per generatrix line and so that two blades located on adjacent generatrix lines present, longitudinally therebetween, a distance which is slightly shorter than, equal to or greater than a length of blade. When a given blade is working, the preceding blade does not serve as stop for the material pushed by the working blade and consequently, the screw effect, which is precisely sought by document FR 2 511 893, is no longer obtained.

The grinder according to the invention preferably comprises n groups of blades having strictly the same arrangement, regularly distributed over the whole periphery of the rotor. The number of groups n is preferably equal to three. In that case, each group of blades occupies a third of the periphery of the rotor.

According to a preferred embodiment of the grinder of the invention, each group of blades comprises at least five blades of which the arrangement, shown flat, is substantially in the form of a W.

If it is question of a grinder of which each group comprises six blades, the arrangement, shown flat, is as illustrated in FIG. 3 of the accompanying drawings. If it is a grinder of which each group comprises eight blades, the arrangement, shown flat, is as illustrated in FIG. 4.

BRIEF DESCRIPTION OF THE DRAWINGS

The invention will be more readily understood on reading the following description of a rotary grinder of which the blades have a heterogeneous arrangement, with reference to the accompanying drawings, in which.

DETAILED DESCRIPTION OF THE DRAWINGS

Figure 1:
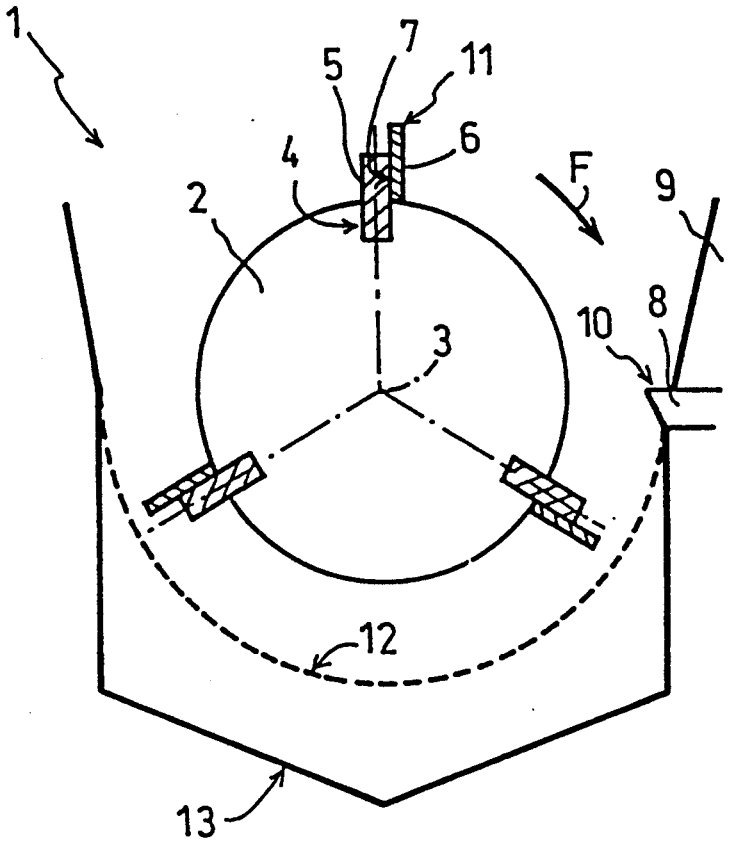
FIG. 1 is a view in section of a grinder equipped with three groups of blades.

Referring now to the drawings, FIG. 1 shows a rotary grinder equipped with blades of a known type, such as described in document FR 2 511 266.

This grinder 1 comprises a rotor 2 driven in rotation by means (not shown) about its shaft 3. This rotor 2 is a cylindrical drum in the periphery of which recesses 4 have been made, serving as housings for blade-holders 5. These blade-holders 5 are plates having the shape of rectangular parallelepipeds which, being placed in their housings 4, have a radial position with respect to the rotor 2.

The blades 6 are plates having the shape of rectangular parallelepipeds. They are placed edgewise on the surface of the rotor 2 in abutment against the front face 7 of that part of the blade-holder 5 which projects beyond the rotor 2. The term "front" is taken here in the sense of the rotation of the rotor in the direction of arrow F. In FIG. 1, the rotor 2 is equipped with three groups of blades 6 and blade-holders 5 distributed symmetrically over the periphery of the rotor 2.

The grinder 1 also comprises a stationary blade 8 fixed on the frame 9. This blade 8 extends longitudinally over the whole length of the grinder facing the rotor 2. Its sharp edge 10 is placed in the immediate proximity of the cylinder described by the front edge 11 of each blade 6. Beneath the rotor 2 is placed a grid 12 of concave shape and, beneath this grid, the recovery hopper 13.

In operation, the materials to be ground, supplied by the upper part of the grinder, arrive above the rotor 2. During rotation of the rotor 2, the edges 11 of the blades 6 strike the materials which are taken between the edges 11 and the fixed edge 10, which brings about division of the material. The finely ground material passes through the meshes of the grid 12 and drops in the hopper 13. On the other hand, the material which is insufficiently ground is driven in rotation by blades 6 and returns into the upper part of the rotor.

Figure 2:
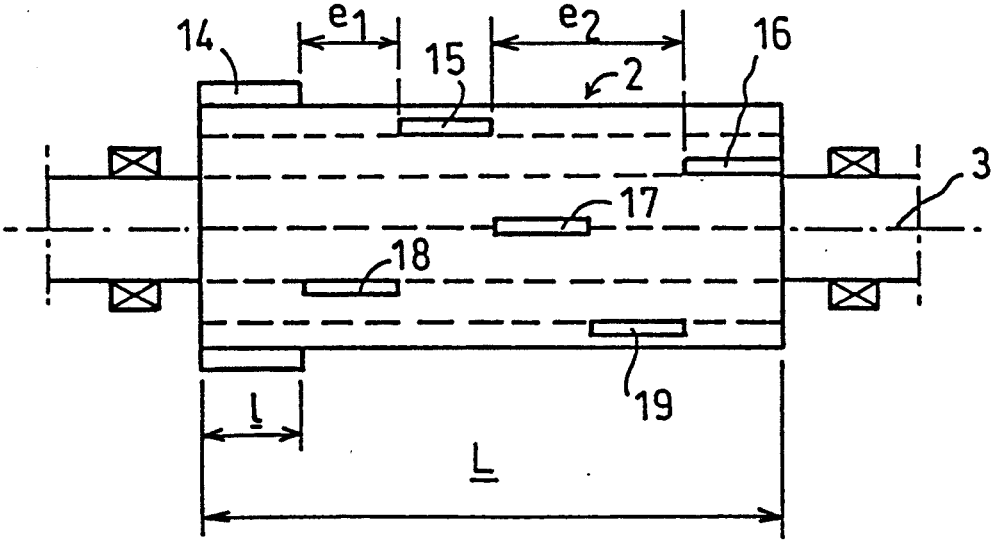
FIG. 2 is a schematic front view of a rotor equipped with two groups of six blades.

According to a characteristic of the invention, the blades are distributed heterogeneously over the whole periphery of the drum. Such distribution is intended to avoid a preferential displacement of the material in a particular zone of the rotor 2. FIG. 2 shows a simplified version of a rotor equipped with two groups of six blades.

Broken lines visualize the generatrix lines along which the different blades are placed. In this first example, there are twelve blades in all, placed along twelve generatrix lines of the rotor 2. References 14, 15, 16, 17, 18 and 19 designate the six blades of the same group which are placed on the successive generatrix lines in the direction of rotation of the rotor. Taken in the longitudinal sense along the axis of rotation 3 of the rotor, each blade is separated from the blade which precedes it or which follows it, by a distance e which is at least approximately equal to the length 1 of a blade. In the example of FIG. 2, it may be noted that the distance e1 between the first blade 14 and the second 15 is equal to the length of a blade 1. The distance e2 between the second blade 15 and the third 16 is equal to twice 1. The distance between the third blade 16 and the fourth 17 is equal to 1. The distance between the fourth blade 17 and the fifth 18 is equal to 1. The distance between the fifth blade 18 and the sixth 19 is equal to twice 1. In this example, the total length L of the rotor is equal to six times 1, i.e. there are no overlapping zones between the blades of the same group. However, this embodiment is not imperative; there may possibly be a certain overlap between the working zones of the blades of the same group, for example, over the whole length L of this same rotor, there may be seven blades and not six.

Figure 3:
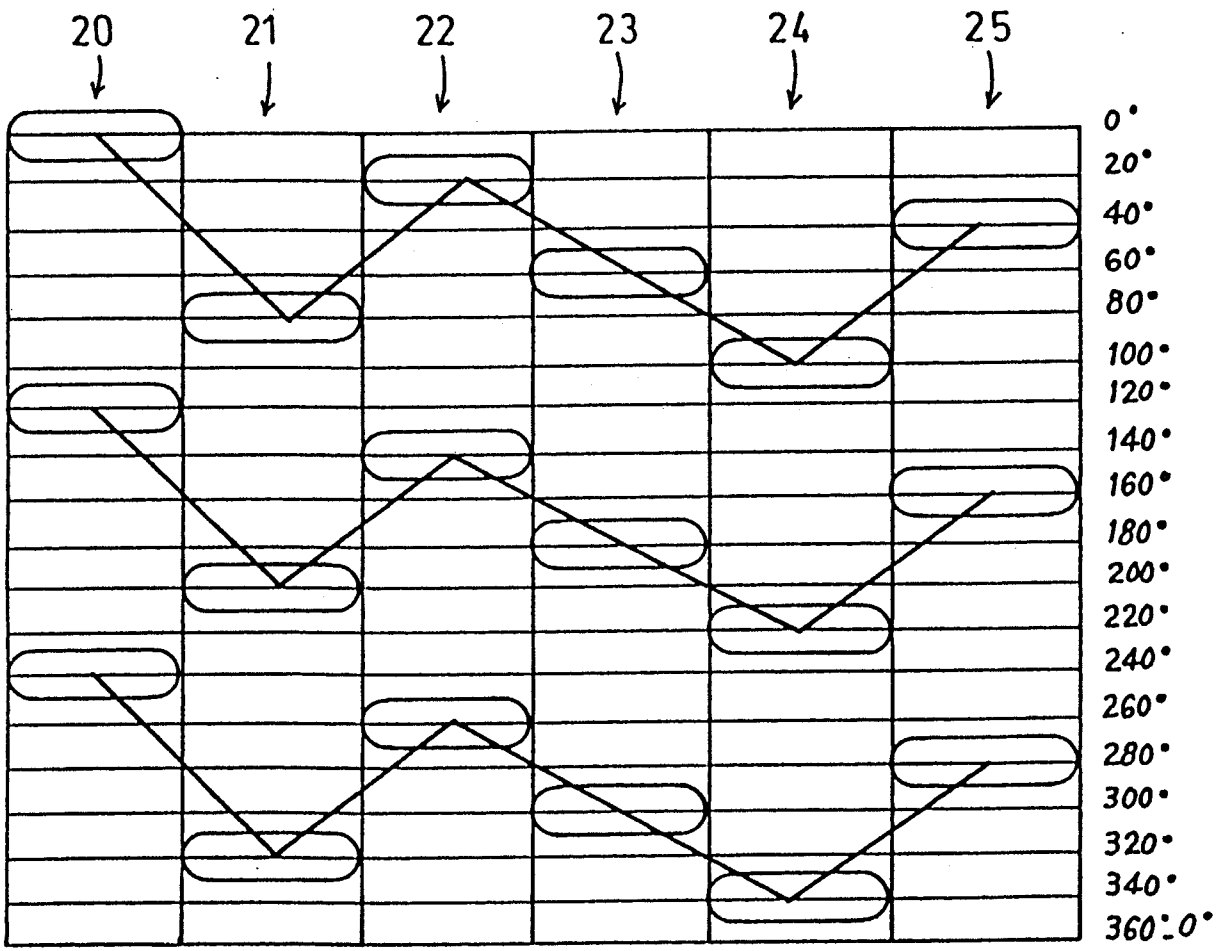
FIG. 3 is a flattened view of a rotor equipped with three groups of six blades.
Figure 4:
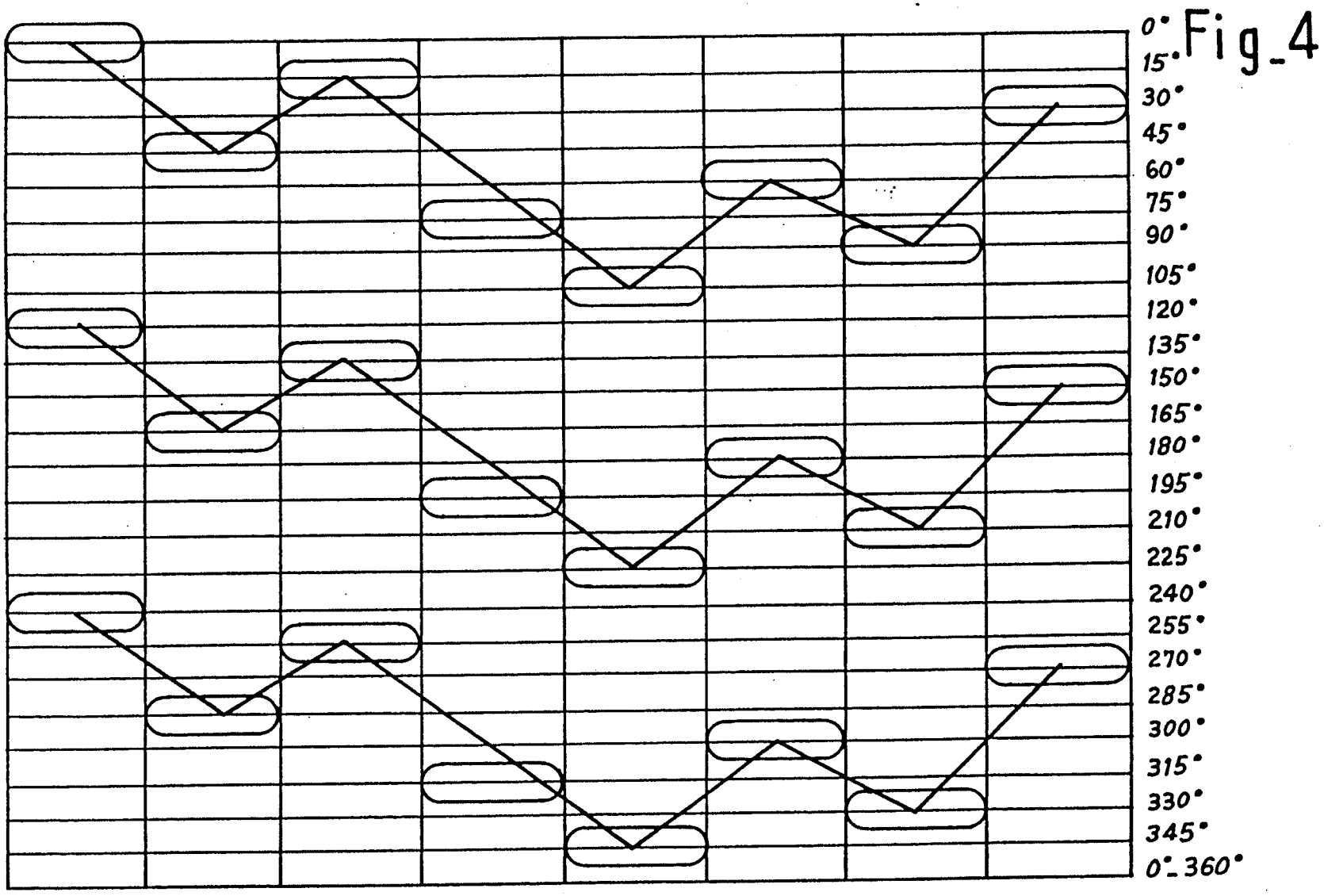
FIG. 4 is a flattened view of a rotor equipped with three groups of eight blades.

FIGS. 3 and 4 are flattened representations of the periphery of two rotary rotors each equipped with three groups of blades presenting a heterogeneous arrangement in accordance with the characteristic of the invention. In the second example illustrated in FIG. 3, it is question of a rotor 180 cm long and equipped with eighteen blades in all, disposed along eighteen generatrix lines of the rotor, two successive generatrix lines being separated by an angle of 20°. In this way, each of the three groups of blades occupies a portion corresponding to a dihedron of 120°. In this second example illustrated in FIG. 3, the arrangement of the blades is strictly identical to that which has just been described with regard to FIG. 2 for the first example. For each of the groups of blades, the arrangement presents a geometrical shape substantially in the form of a W as represented by a fictitious line in FIG. 3.

During operation of the grinder, the material to be ground is supplied from a supply hopper over the whole length of the rotor. During rotation of the latter, each blade strikes the material in its own working zone. In the present case, there are therefore six successive working zones 20, 21, 22, 23, 24 and 25 over the whole length of the rotor. In each zone, the material is worked successively by the action of three blades, namely one blade per group. Moreover, being given that each generatrix line comprises only one blade, the material is worked only by one blade at a time. Being given that two successive blades, i.e. belonging to two generatrix lines separated by 20°, present therebetween a distance which is approximately equal to or greater than the length of a blade, it will be understood that the material which is worked by one of these blades cannot bear on the preceding blade. In this way, the screw effect which is provided in document FR 2 511 893 is not obtained. On the contrary, it is observed that there is a perfectly homogeneous, regular distribution of the material to be ground all along the rotor 2, without notable, privileged displacement of this material in one of the working zones 20 to 25.

FIG. 4 is a flattened representation of the periphery of a rotor 240 cm long, equipped with twenty four blades disposed heterogeneously according to the invention along twenty four generatrix lines separated from one another by a dihedron of 15°. The twenty-four blades are distributed in three groups of eight blades. The eight blades of the same group extend along eight working zones representing the whole length of the rotor. As in the second example illustrated in FIG. 3, the eight blades present a broken-line zig-zag geometrical arrangement. Furthermore, an arrangement of a W and a V connection is shown, wherein the W arrangement described hereinabove in the first and the second example is found again.

Figure 5:
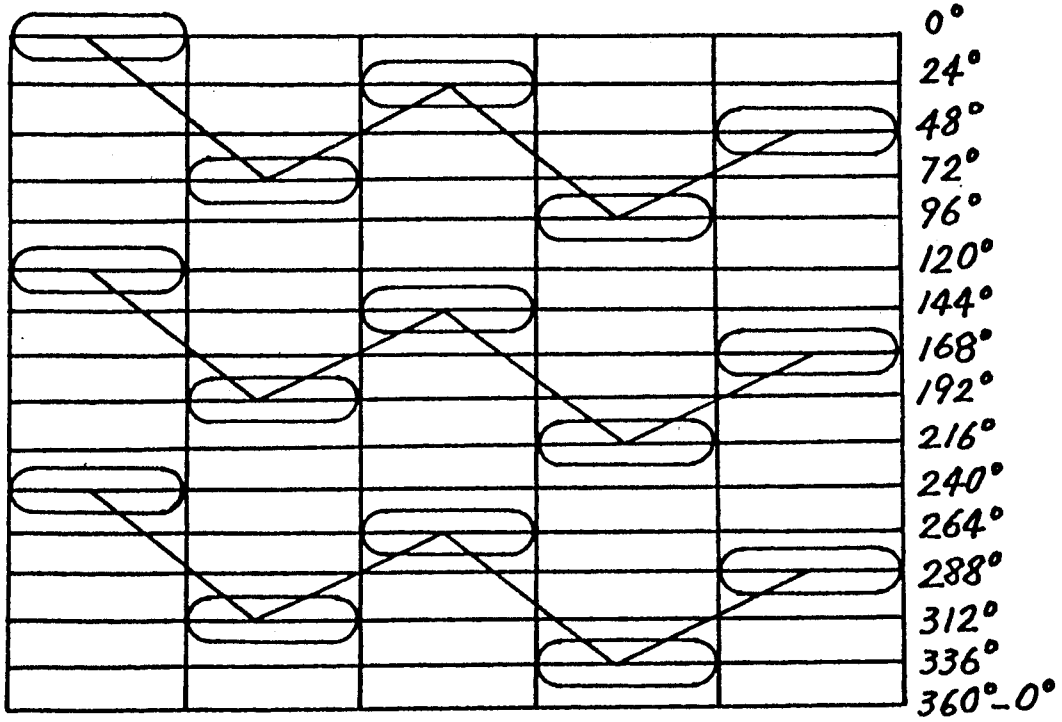
FIG. 5 is a flattened view of a rotor equipped with three groups of five blades.

FIG. 5 shows an embodiment of three groups of five blades. Each group occupies a portion of the rotor corresponding to a dihedral of 96°. Two adjacent generatrix lines are separated by 24°.

The preferred embodiments described hereinabove are not exhaustive of the invention but are given by way of non-limiting examples. Other heterogeneous arrangements of the blades may be provided by the man skilled in the art as a function of the length of the rotor and of the number of blades to be disposed on the periphery thereof.

What is claimed is:

1. A rotary grinder employing blades, which comprises:

a) a substantially cylindrical rotor, b) at least one group of identical blades mounted on the rotor along a plurality of longitudinal generatrix lines, wherein said generatrix lines are regularly and equally spaced apart around the peripheral surface of the cylindrical rotor, each of said blades having a length shorter than the longitudinal length of the rotor; and c) a stationary blade fixed on the frame said stationary blade including a straight cutting edge extending longitudinally along the whole length of the rotor and adjacent the rotor, said stationary blade along with said blades on the cylindrical rotor defining a continuous working zone representing the whole length of the rotor;

wherein the group of blades are disposed on the rotor at a rate of only one blade per generatrix line such that two blades located on adjacent generatrix lines present longitudinally therebetween a distance approximately equal to or greater than the length of one of the blades, and the blades on said rotor are parallel with the generatrix lines, and are disposed to continuously cover the whole length of the rotor to define said continuous working zone which continuously covers the whole length of the rotor.

2. The grinder of claim 1, wherein there are three groups of blades each group of blades continuously covering the whole length of the rotor and having strictly the same arrangement, said three groups being regularly distributed over the whole peripheral surface of the rotor.

3. The grinder of claim 2, wherein each of said groups comprises at least five blades with an arrangement extending along the length of the rotor substantially in the form of a W, stretching longitudinally over the whole length of the rotor.

4. The grinder of claim 2, wherein each of said groups comprises six blades with an arrangement extending along the length of the rotor substantially in the form of a W, stretching longitudinally over the whole length of the rotor.

5. The grinder of claim 2, wherein each of said groups comprises eight blades with an arrangement extending along the length of the rotor substantially in the form of a W and a V connection, stretching longitudinally over the whole length of the rotor.

* * * * *